US008622717B1

(12) United States Patent
Osterhaus et al.

(10) Patent No.: US 8,622,717 B1
(45) Date of Patent: Jan. 7, 2014

(54) HIGH-PERFORMANCE OIL PUMP

(75) Inventors: Michael J. Osterhaus, Jackson, MI (US); Nathaniel D. Stucky, Brooklyn, MI (US)

(73) Assignee: Melling Tool Company, Jackson, MI (US)

( * ) Notice: Subject to any disclaimer, the term of this patent is extended or adjusted under 35 U.S.C. 154(b) by 590 days.

(21) Appl. No.: 12/262,391

(22) Filed: Oct. 31, 2008

Related U.S. Application Data

(60) Provisional application No. 61/001,176, filed on Oct. 31, 2007.

(51) Int. Cl.
*F04B 49/00* (2006.01)

(52) U.S. Cl.
USPC ..... 417/310; 417/440; 418/201.2; 418/206.1

(58) Field of Classification Search
USPC ..... 417/307, 310, 440; 418/201.2, 201.1, 418/206.1, 270
See application file for complete search history.

(56) References Cited

U.S. PATENT DOCUMENTS 2,623,469 A * 12/1952 Gray ..... 417/310
2,684,631 A 7/1954 Anthony et al.
3,029,740 A 4/1962 Maisch
3,091,306 A * 5/1963 Thomas ..... 184/27.1
4,392,798 A * 7/1983 Bowden ..... 418/102
6,047,684 A 4/2000 Hiraku et al.
6,186,750 B1 * 2/2001 Hunter ..... 417/307
6,189,411 B1 2/2001 Francis
6,210,138 B1 * 4/2001 Cortez ..... 418/132
6,729,855 B2 * 5/2004 Havlik et al. ..... 417/310
6,935,851 B2 8/2005 Peters et al.
2007/0134122 A1 6/2007 Wang et al.

* cited by examiner

*Primary Examiner* — Devon Kramer
*Assistant Examiner* — Thomas Fink
(74) *Attorney, Agent, or Firm* — Young Basile Hanlon & MacFarlane P.C.

(57) ABSTRACT

A high-performance oil pump for pumping oil in an internal combustion engine that eliminates or greatly reduces cavitation in the oil pump, thereby increasing the efficiency and performance of the oil pump. The present invention provides a housing having an inlet for receiving a supply of oil and an outlet for discharging the oil. At least two gears rotatably and matingly are disposed within the housing for pumping the oil from the inlet to the outlet. A pressure regulation circuit is disposed within the housing for balancing oil flow pressure between the inlet and the outlet by redirecting a portion of the oil from the outlet to the inlet when said oil flow pressure reaches a predetermined level at the outlet in order to reduce or eliminate cavitation of oil in the oil pump.

2 Claims, 5 Drawing Sheets

HIGH-PERFORMANCE OIL PUMP

CROSS-REFERENCE TO RELATED APPLICATIONS

This application is related to, and claims the benefit of priority from, U.S. Provisional Patent Application Ser. No. 61/001,176, filed Oct. 31, 2007.

FIELD OF THE INVENTION

The present invention relates to oil pumps, and in particular, a high-performance external involute gear-style oil pump that eliminates or greatly reduces cavitation in the oil pump, thereby increasing the efficiency and performance of the oil pump.

BACKGROUND OF THE INVENTION

Cavitation is an undesirable condition that often occurs in external involute gear-style oil pumps that are commonly used on internal combustion engines. Cavitation occurs when the static pressure at any point in the fluid flow of the fluid being pumped becomes less than the fluid's vapor pressure, thereby creating vapor bubbles in the inlet fluid stream. When this situation arises in an oil pump, vapor bubbles in the inlet oil stream reach the high-pressure side or outlet side of the oil pump and implode, thereby causing noise, vibration, and damage to any surface of the oil pump in which the imploding bubbles touch. The effects of cavitation can range from a loss of oil pump efficiency, a reduction in the oil pumps' output, or more serious effects, such as noise, vibration, and damage to the oil pump's components.

The onset of cavitation is determined by the oil pump's speed, capacity, and inlet design. In addition, external involute gear-style oil pumps tend to cavitate at relatively low operating speeds as compared to other pump designs. Cavitation has caused lubrication issues with many high-performance engines, since many of those engines utilize an external involute gear-style oil pump. Because of this condition, many high-performance engines utilize a dry sump oiling system; however, such dry sump oiling systems are more expensive and complex, thereby increasing the cost and maintenance of such systems.

SUMMARY OF THE INVENTION

The present invention provides a high-performance oil pump for pumping engine oil in an internal combustion engine in order to reduce or eliminate cavitation of the oil in the oil pump. The present invention provides a housing having an inlet for receiving oil and an outlet for discharging oil. At least two gears are rotatably and matingly disposed within a pumping chamber of the housing for pumping oil from the inlet to the outlet. An inlet passageway extends from the inlet to the inlet side of the pumping chamber, and an outlet passageway extends from an outlet side of the pumping chamber to the outlet. A pressure regulating circuit disposed within the housing redirects oil from the outlet side of the pumping chamber to the inlet passageway when the pressure differential between the outlet side of the pumping chamber and the inlet side of the pumping chamber exceeds a predetermined level in order to reduce or eliminate cavitation of oil in the oil pump.

The pressure regulation circuit of the present invention provides a pressure relief valve having a spool valve structure disposed within the bore of the housing. A redirect outlet passageway communicates with the outlet side of the pumping chamber and the pressure relief valve. A redirect inlet passageway communicates with the pressure relief valve and the inlet passageway. The pressure relief valve is moveable between a normally closed position, wherein oil is prevented from passing from the redirect outlet passageway to the redirect inlet passageway, and an open position, wherein oil is allowed to pass from the redirect outlet passageway to the redirect inlet passageway. The relief valve is biased in the closed position and moves from the closed position to the open position when the pressure differential between the redirect outlet passageway and the redirect inlet passageway exceeds a predetermined level.

The inlet of the housing provides an opening that is communicatable with a supply of oil, and the opening of the inlet has a larger diameter than the inlet passageway. A strainer is removably connected to and extends across the inlet for filtering oil and minimizing a pressure drop of oil prior to entering the inlet passageway. The inlet passageway has a longitudinal axis that extends directly from the inlet to the inlet side of the pumping chamber.

A venting passageway extends from the inlet to the bore in the housing for receiving the relief valve in order to maintain atmospheric pressure on both sides of the relief valve.

BRIEF DESCRIPTION OF THE DRAWINGS

Various other uses of the present invention will become more apparent by referring to the following detailed descriptions and drawings, and which.

DETAILED DESCRIPTION OF THE PREFERRED EMBODIMENT

Figure 1:
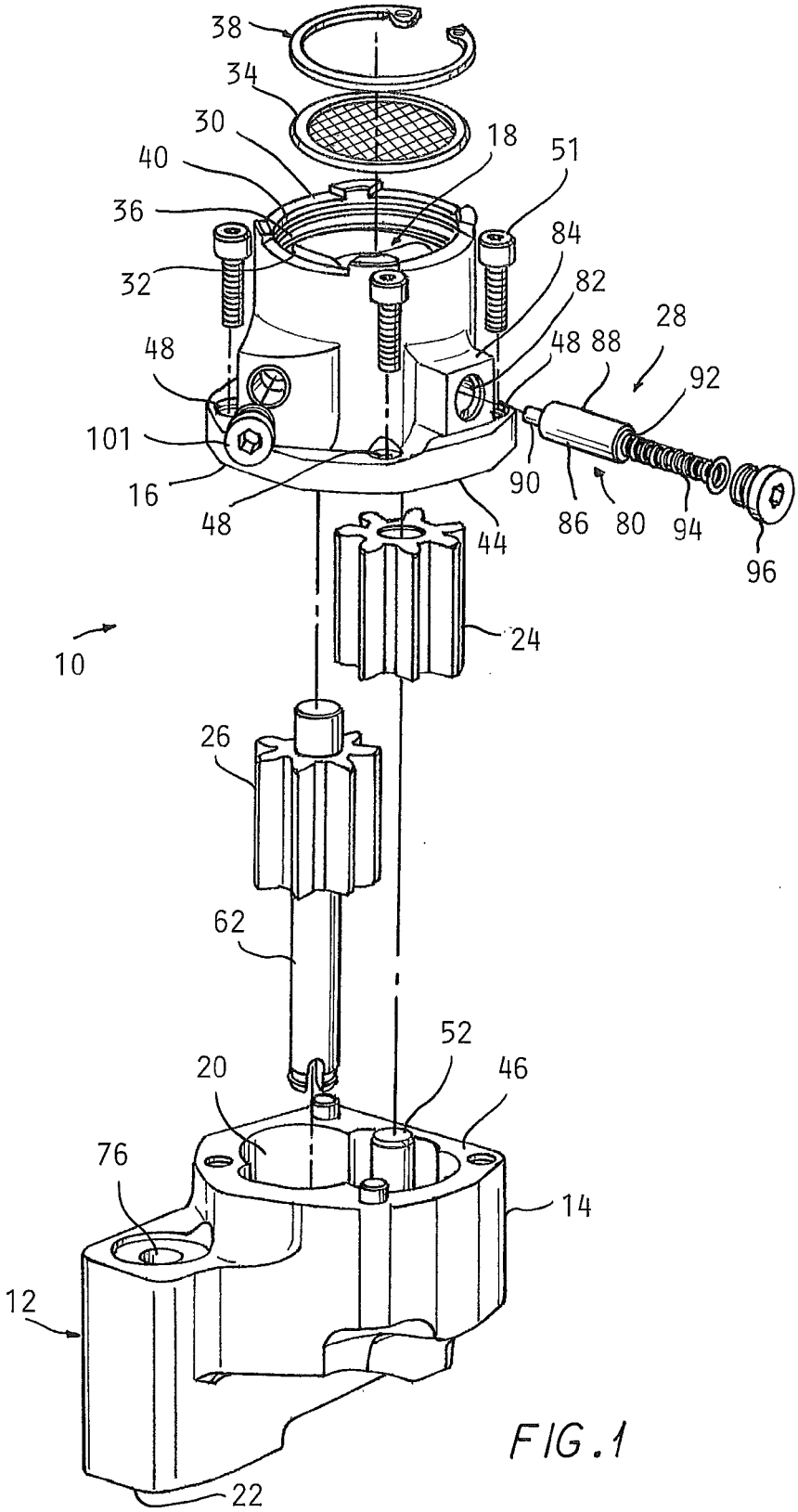
FIG. 1 is an exploded view of the high-performance oil pump of the present invention.

Referring to the drawings, the present invention will now be described in detail with reference to the disclosed embodiments.

Figure 2:
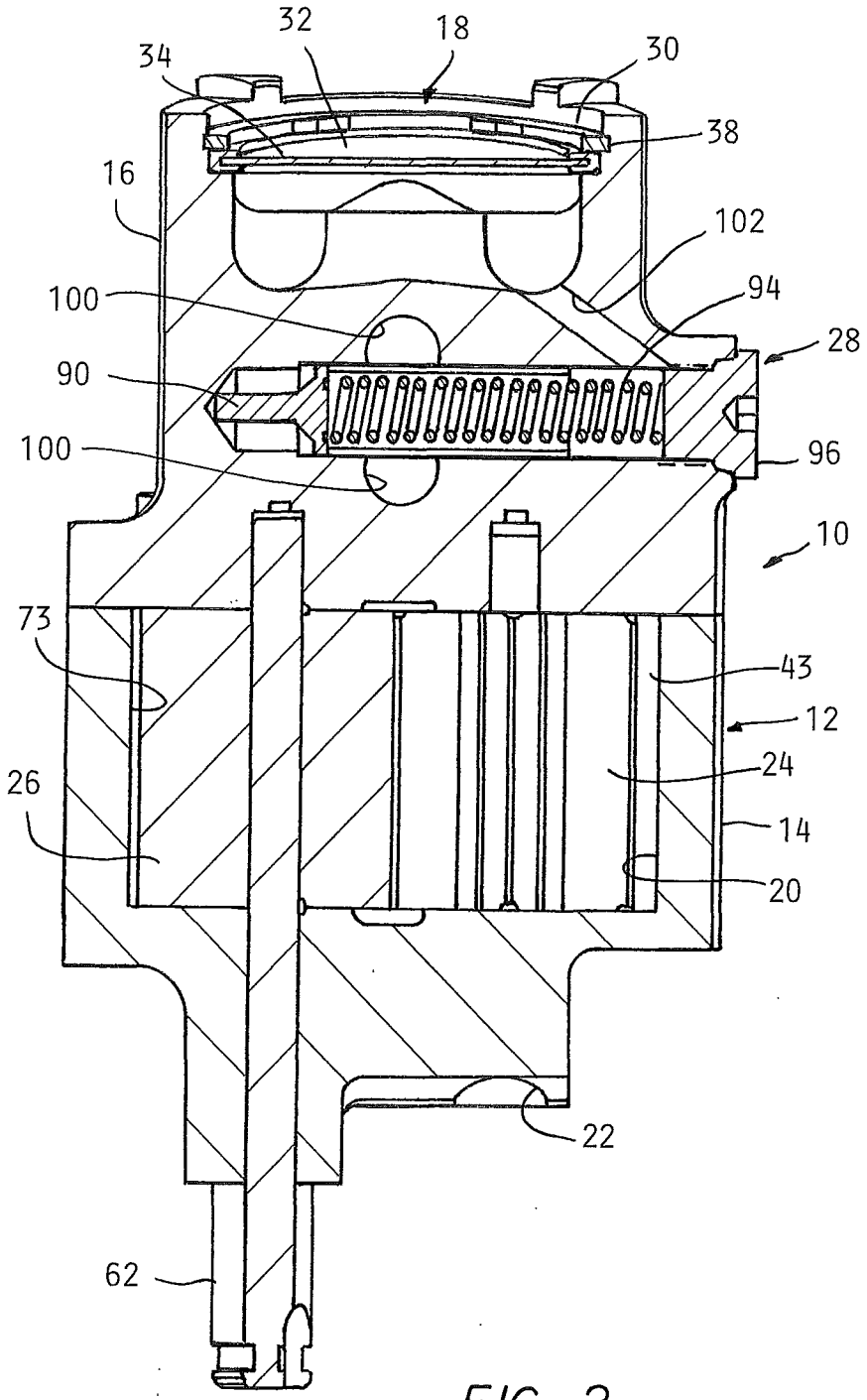
FIG. 2 is a sectional view of the high-performance oil pump of the present invention.
Figure 3:
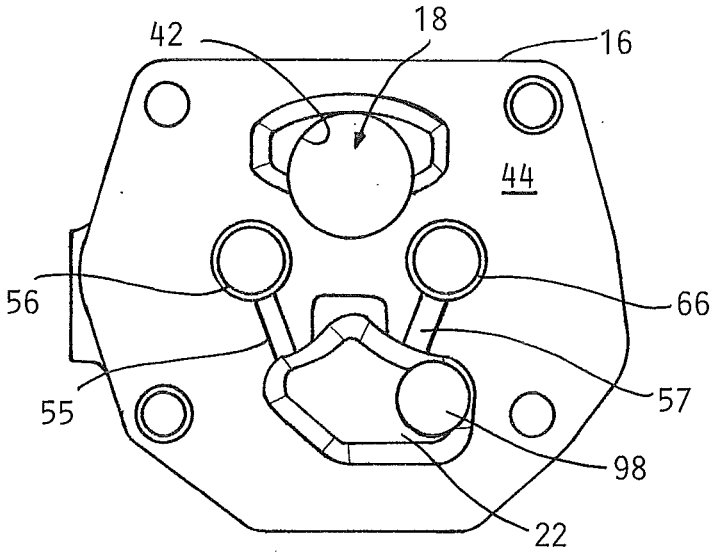
FIG. 3 is a top plan view of the oil pump cover of the high-performance oil pump of the present invention.
Figure 4:
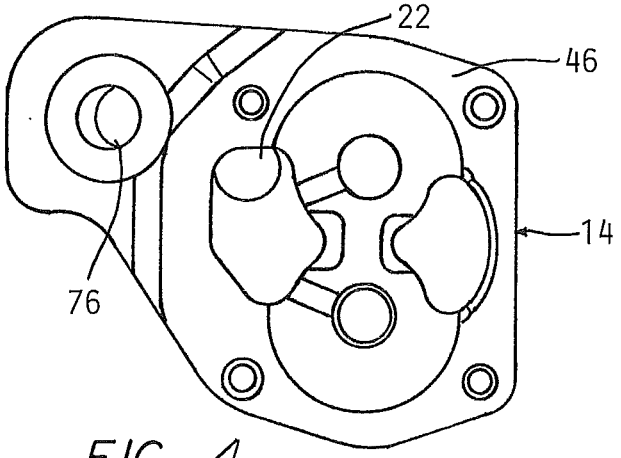
FIG. 4 is a top plan view of the oil pump body of the high-performance oil pump of the present invention.
Figure 5:
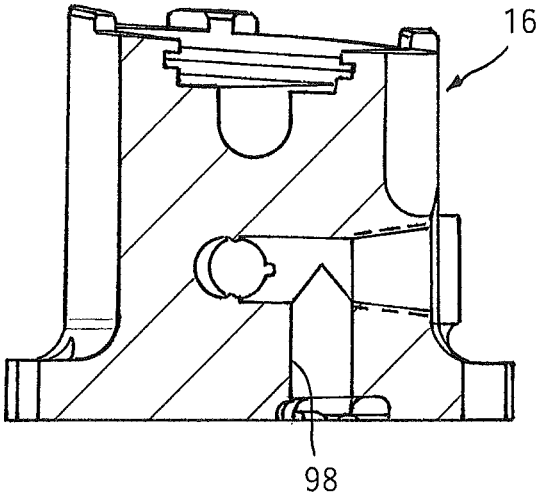
FIG. 5 is a sectional view of the oil pump cover of the high-performance oil pump of the present invention.
Figure 6:
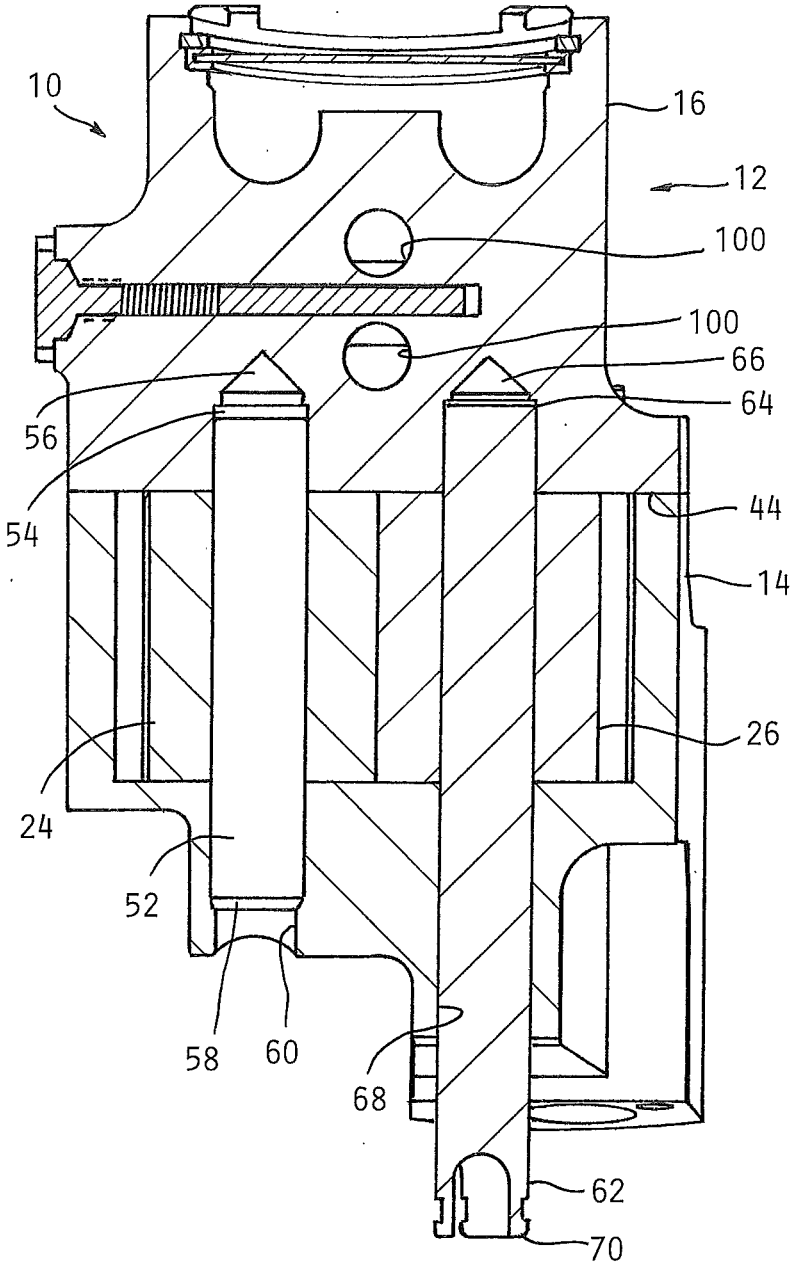
FIG. 6 is a sectional view of the high-performance oil pump of the present invention.
Figure 7:
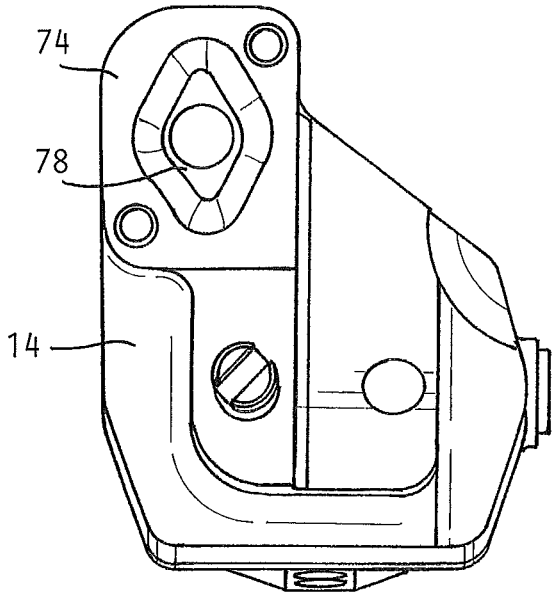
FIG. 7 is a top plan view of the high-performance oil pump of the present invention.
Figure 8:
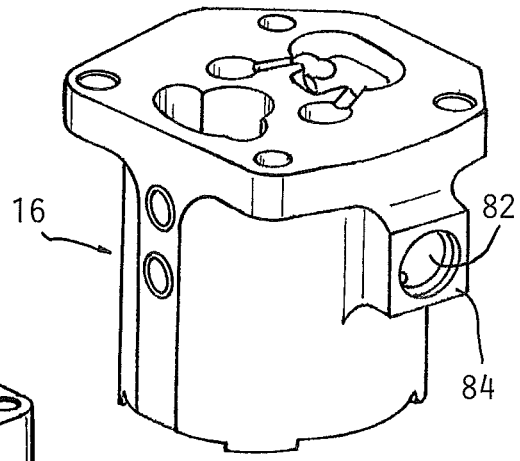
FIG. 8 is an isometric view of the oil pump cover of the high-performance oil pump of the present invention.
Figure 9:
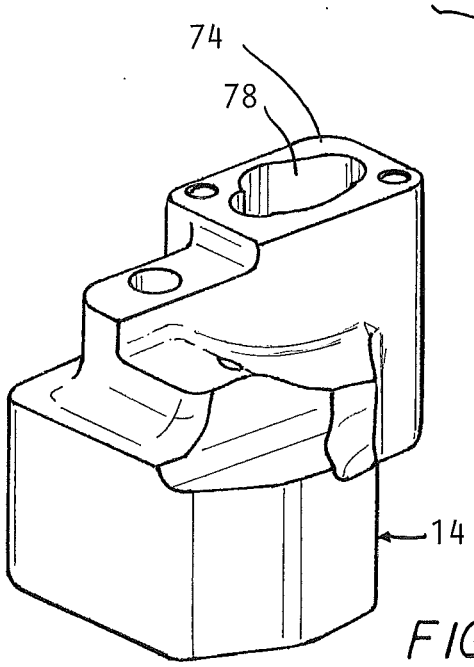
FIG. 9 is an isometric view of the oil pump of the high-performance oil pump of the present invention.

FIGS. 1-10 illustrate a high-performance oil pump 10 of the present invention for reducing or eliminating cavitation of oil in the oil pump 10. The oil pump 10 provides a housing 12 having an oil pump body 14 and an oil pump cover 16. The oil pump cover 16 has an inlet 18 formed therein for receiving oil (not shown) from an oil supply reservoir (not shown), such as an oil pan from an internal combustion engine (not shown). The inlet 18 is in communication with a hollow pumping chamber 20 formed in the oil pump body 14 of the housing 12. An outlet 22 is also formed in the oil pump body 14 and is in communication with the pumping chamber 20. A pair of gears 24, 26 are rotatably disposed within the pumping chamber 20 of the oil pump body 14 and are driven by the engine. The gears 24, 26 pump oil from the inlet 18 to the outlet 22 of the housing 12, and the outlet 22 of the housing 12 is connected to and communicates with an engine block of the engine so as to provide oil to the engine block. A pressure regulation circuit 28 disposed within the housing 12 balances oil flow pressure between the inlet 18 and the outlet 22 by redirecting a portion of the oil from the outlet 22 to the inlet 18 of the oil pump 10 when the oil flow pressure differential between the outlet 22 and the inlet 18 reaches a predetermined level. By allowing oil to flow from the outlet 22 to the inlet 18, especially under high speed engine conditions, an appropriate amount of oil is supplied to the inlet 18, thereby ensuring a proper supply of oil to the pumping chamber 20 and reducing or avoiding cavitation of the oil in the oil pump 10. By reducing or eliminating cavitation, the efficiency and performance of the oil pump 10 is increased.

In order to provide the housing 12 of the present invention with the appropriate structural strength and weight, the oil pump body 14 and the oil pump cover 16 of the housing 12 may be fabricated from billet 6061-T6 aluminum, which is hard-coated and anodized for durability. Although the noted aluminum is an ideal material for the housing 12 of the oil pump 10, it should be noted that the present invention is not limited to such material, but rather, various other materials having similar strength and weight properties can be utilized.

The oil pump cover 16 has a substantially cylindrical configuration with the inlet 18 formed at an open end 30 of the oil pump cover 16. The initial opening 32 of the inlet 18 extends across almost the entire width of the end 30 of the oil pump cover 16. The intial opening 32 of the inlet 18 is relatively large and sized accordingly in order to reduce flow restriction of the oil. A steel mesh strainer 34 is seated within an annular recess 36 in the inlet 18 of the oil pump cover 16, and a removable retaining ring 38 is also seated in an annular recess 40 in the inlet 18 of the oil pump cover 16 so as to secure the strainer 34 in the oil pump cover 16. Since an oil filter (not shown) is typically downstream from the oil pump 10, the oil being supplied from the oil pan to the oil pump 10 is not filtered. Thus, the strainer 34 filters any contaminates in the oil and prevents such contaminates from entering the oil pump 10 of the present invention while minimizing the amount of pressure drop across the strainer 34. The retaining ring 38 can be easily removed from the oil pump cover 16, thereby allowing regular maintenance to be performed on the strainer 34. For example, the strainer 34 can be removed, cleaned, and replaced in the oil pump cover 16. Since the strainer 34 can provide restriction of the oil flow into the inlet 18, the initial opening 32 of the inlet 18 from the oil pump cover 16 is relatively large, as previously mentioned, to ensure for the proper flow of oil into the inlet 18.

For oil to be pumped from the oil supply to the pumping chamber 20, the inlet 18 in the oil pump cover 16 provides an inlet passageway 42 extending from and in communication with the initial opening 32 of the inlet 18 of the oil pump cover 16. Although the inlet passageway 42 is smaller in diameter than the initial inlet opening 32, the inlet passageway 42 is still larger than most conventional designs in order to reduce flow restriction of the oil. The length of the inlet passageway 42 is also designed to be as short a distance as possible to the pumping chamber 20 in order to reduce the restriction of flow to the incoming oil. Again, the initial opening 32 is larger than the inlet passageway 42 to ensure that there is no flow resistance caused by the strainer 34. The inlet passageway 42 has a longitudinal axis that is laterally offset from the longitudinal axis of the oil pump cover 16, and the inlet passageway 42 extends substantially straight through the oil pump cover 16 to communicate with an inlet side 43 of the hollow pumping chamber 20 provided in the oil pump body 14. Thus, the inlet 18 provides communication between the oil supply and the pumping chamber 20 of the housing 12.

In order to pump oil from the oil supply through the inlet 18 and out through the outlet 22, the oil pump cover 16 has a substantially rectangular stepped configuration, wherein a substantially flat mating surface 44 on the oil pump cover 16 abuts a substantially flat mating surface 46 on the oil pump body 14. Four apertures 48 extend through the mating surface 44 of the oil pump cover 16 and are correspondingly aligned with four threaded apertures 50 in the mating surface 44 of the oil pump body 14. Four conventional threaded fasteners 51 extend through the apertures 48 and thread into apertures 50 to secure the oil pump cover 16 to the oil pump body 14.

The gears 24, 26 of the oil pump 10 are disposed within the hollow pumping chamber 20 of the oil pump body 14 wherein the pumping chamber 20 is open to the mating surfaces 44, 46 of the oil pump body 14 and the oil pump cover 16. The pair of gears 24, 26 are external involute gears that are substantially similar and are designed to mesh together in a complementary manner. The first gear 24 has a throughbore extending along its longitudinal axis for receiving an idler shaft 52 wherein the first gear 24 is press fit onto the idler shaft 52. The idler shaft 52 has one of its ends 54 received within a blind bore 56 provided in the mating surface 44 of the oil pump cover 16. A small trough 55 provided on the mating surface 44 of the oil pump cover 16 directs oil from the pumping chamber 20 to the blind bore 56 to lubricate the end 54 of the idler shaft 52. The other end 58 of the idler shaft 52 extends through a throughbore 60 in the oil pump body 14. The throughbore 60 has a stepped-diameter to secure the idler shaft 52 in the housing 12. The first gear 24 is then free to rotate with the idler shaft 52 within the pumping chamber 20 of the oil pump body 14.

The second gear 26 also has a throughbore extending along the longitudinal axis of the second gear 26. A drive shaft 62 is inserted through the throughbore of the second gear 26 wherein the second gear 26 is press-fit to the drive shaft 62. One end 64 is seated within a blind bore 66 extending from the mating surface 44 of the oil pump cover 16. A small trough 57 is provided on the mating surface 44 of the oil pump cover 16 to direct oil from the pumping chamber 20 to the blind bore 66 to lubricate the end 64 of the drive shaft 62. A throughbore 68 extending through the oil pump body 14 receives the drive shaft 62. A free end 70 of the drive shaft 62 extends outward beyond the oil pump body 14 and is coupled to a portion of the engine, such as a crankshaft or a camshaft. The second gear 26 is disposed within the pumping chamber 20 of the oil pump body 14 and rotates with the drive shaft 62. The first and second gears 24, 26 are situated such that when the second gear 26 is driven by the drive shaft 62, the second gear 26 rotates in a meshing and complementary fashion with the first gear 24. Since the drive shaft 62 is connected to the camshaft or crankshaft of the engine, the speed at which the gears 24, 26 rotate is in direct relation to the speed of the engine.

To pump the oil from the inlet 18 through to the outlet 22, an outlet passageway 72 extends from an outlet side 73 of the pumping chamber 20 of the oil pump body 14 to an outlet opening 78 which extends to an outside landing 74 on the oil pump body 14. The outlet opening 78 is larger in diameter than the outlet passageway 72 and is relatively large and sized accordingly in order to reduce the restriction of oil flow. A through-hole 76 extending from the opposite side of the oil pump body 14 extends into the outlet opening 78 of the oil pump body 14. The through-hole 76 allows for a fastener (not shown) to extend up through the through-hole 76, thereby connecting the landing 74 of the oil pump body 14 directly to the engine block of an engine. This allows the oil pump 10 of the present invention to pump the oil from the inlet 18 to the outlet 22 and into the engine block of the engine.

In order to regulate and balance oil flow pressure between the outlet 22 and the inlet 18 of the oil pump, the pressure regulation circuit 28 provides a relief valve 80 slidably disposed within the oil pump cover 16. The relief valve 80 is movable between a normally closed position, wherein oil is prohibited from flowing from the outlet 22 to the inlet 18, and an open position, wherein oil is allowed to flow from the outlet 22 to the inlet 18 to ensure a proper supply of oil to the pumping chamber 20, thereby reducing or avoiding cavitation of the oil in the oil pump 10. The relief valve 80 is disposed within the oil pump cover 16 in a blind bore 82 extending through an integral boss 84 formed on the outside of the oil pump cover 16. The relief valve 80 provides a spool valve 86 slidably disposed within the blind bore 82 for movement between the closed position and the open position. The spool valve 86 has a larger diameter portion 88, which is slightly smaller than the diameter of the blind bore 82, and a smaller diameter portion 90 that is integral with and extends from the larger diameter portion 88 of the spool valve 86. The smaller diameter portion 90 of the spool valve 86 may abut the end of the blind bore 82 in order to prohibit further movement of the spool valve 86 at that end of the bore 82. The larger diameter portion 88 of the spool valve 86 has a blind bore 92 extending from the end of the spool valve 86. A helical compression spring 94 is inserted into the bore 92 of the spool valve 86, wherein a portion of the helical compression spring 94 extends outward from the spool valve 86 and is housed within the blind bore 82 in the oil pump cover 16. A plug 96 is threaded into corresponding threads provided in the opening of the blind bore 82 in the boss 84 of the oil pump cover 16. The plug 96 secures the spool valve 86 and the gear 24 within the blind bore 82 in the oil pump cover 16 and acts as an abutment to one end of the compression spring 94.

In order for the relief valve 80 to redirect oil from the outlet 22 to the inlet 18 when the flow pressure differential between the outlet 22 and the inlet 18 reaches a predetermined level, a redirected outlet passageway 98 is formed on the mating surface 44 of the oil pump cover 16 and is in communication with the outlet side 73 of the pumping chamber 20. This redirected outlet passageway 98 extends from the pumping chamber 20 to the end of the blind bore 82 in the oil pump cover 16 that houses the relief valve 80. This provides communication between the outlet 22 and the blind bore 82 housing the relief valve 80. Thus, the outlet pressure of the oil is constantly in communication with the relief valve 80, and when the outlet pressure becomes great enough to overcome the force of the compression spring 94 on the spool valve 86, the spool valve 86 will begin to move against the force of the compression spring 94. The compression spring 94 has a predetermined spring force that corresponds to a desired outlet pressure wherein oil from the outlet 22 is redirected to the inlet 18.

When the outlet pressure becomes too great, the spool valve 86 moves to the open position, and oil is allowed to flow from the outlet 22 to the inlet 18 of the oil pump 10. To redirect such flow of oil, a redirected inlet passageway 95 is provided by a pair of blind bores 100 that extends between the inlet passageway 42 and the blind bore 82 that houses the relief valve 80. The blind bores 100 have longitudinal axes that are substantially perpendicular to the longitudinal axis of the inlet passageway 42. Thus, the redirected inlet passageway 95 provides communication from the blind bore 82 housing the relief valve 80 to the inlet passageway 42. At the end of the pair of blind bores 100 that extends outward from the oil pump cover 16, a plug 101 is threaded into the oil pump cover 16 to maintain the oil within the oil pump 10. Thus, when the outlet pressure becomes too great and the spool valve 86 moves to the open position, the oil from the redirected outlet passageway 98 travels into the blind bore 82 housing the relief valve 80 and into the redirected inlet passageway, which allow for oil to travel back to the inlet passageway 42. This supply of oil is added to the normal supply of oil in the inlet 18, thereby providing an additional supply of oil to the gears 24, 26 within the pumping chamber 20 of the housing 12. This additional supply of oil ensures a sufficient supply of oil so as to reduce or eliminate the onset of cavitation within the oil pump 10. The redirected outlet passageway and the redirected inlet passageway are substantially straight and direct so as to reduce the length and turns within the redirected passageways. This assists in avoiding any flow restriction of the oil.

It should also be noted that a small venting passageway 102 extends from the inlet 18 to the backside of the spool valve 86. This allows atmospheric pressure to be provided on the backside of the spool valve 86 so that the spool valve 86 can move freely between the open and closed positions, thereby avoiding vacuum within the blind bore housing the spool valve 86.

In operation, the initial opening 32 of the inlet 18 of the oil pump 10 of the present invention may be located within an oil pan of an engine, and the outlet 22 of the oil pump 10 may be connected to the engine block of an engine. Once the engine begins operating, the drive shaft 62 of the oil pump 10 is driven by the crankshaft or camshaft of the engine. The drive shaft 62 drives the second gear 26, which, in turn, drives the first gear 24. As the gears 24, 26 rotate, the un-meshing of the gears 24, 26 create a local drop in pressure, which draws the oil into the inlet 18 of the oil pump 10 from the oil pan. The incoming oil flows into the pumping chamber 20 due to the un-meshing of the gears 24, 26. As the oil pump 10 speed increases with the engine speed, so does the speed of the gears 24, 26, and, as a result, the fill time of the oil into the pumping chamber 20 is reduced to the point at which the incoming oil does not have enough time to fill the pumping chamber 20. This is when cavitation may start to occur.

In order to reduce or eliminate the onset of cavitation, the outlet pressure of the oil begins to reach a level wherein the spool valve 86 begins to move from the first or closed position, wherein oil is prohibited from flowing from the outlet 22 to the inlet 18, to the second or open position, wherein a portion of the oil from the outlet 22 is allowed to flow to the inlet 18. As the outlet pressure forces the spool valve 86 against the compression spring 94, the spool valve 86 continues to move toward the open position until the larger diameter portion 88 of the spool valve 86 moves beyond the pair of blind bores 100 provided in the oil pump cover 16. When this occurs, the spool valve 86 is in the open position, and a portion of the oil travels from the outlet side 73 of the pumping chamber 20, through the redirect outlet passageway 98, through the redirect inlet passageway 95, through the inlet passageway 42, and into the inlet side 43 of the pumping chamber 20. This provides a sufficient amount of oil to the pumping chamber 20 so that the oil pump 10 does not begin to cavitate.

Once the oil pressure at the outlet 22 is reduced, such as by the slowing of the engine, the outlet pressure delivered to the spool valve 86 begins to drop. When this occurs, the compression spring 94 forces the spool valve 86 back toward the closed position, thereby closing the redirect inlet passageway to the inlet passageway 42. This prohibits the flow of oil from the outlet 22 to the inlet 18, as there is now a sufficient supply of oil to the pumping chamber 20.

It should be noted that various engine configurations may require various oil pump 10 configurations of the present invention. For instance, the oil inlet 18 and strainer 34 may have to be a further distance laterally to communicate with the oil pan. In addition, height limitations may require a reduction in the number or a rerouting of the oil flow passageways. Lastly, various engine sizes may require various size oil pumps 10 of the present invention.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. A high-performance oil pump for pumping oil in an internal combustion engine, comprising:

a housing having one inlet for receiving oil and one outlet for discharging oil, wherein said inlet has a longitudinal axis;

a pair of gears rotatably and matingly disposed within a pumping chamber of said housing for pumping oil from said inlet to said outlet, wherein said pumping chamber has a longitudinal axis;

an inlet passageway extending from said inlet to an inlet side of said pumping chamber, wherein said inlet passageway has a longitudinal axis substantially parallel to said longitudinal axis of said pumping chamber and said longitudinal axis of said inlet;

an outlet passageway extending from an outlet side of said pumping chamber to said outlet;

a pressure regulating circuit disposed within said housing redirects oil from said outlet side of said pumping chamber to said inlet passageway when the pressure differential between said outlet of said pumping chamber and said inlet side of said pumping chamber exceeds a predetermined level in order to reduce or eliminate cavitation of oil in said oil pump;

said pressure regulating circuit having a pressure relief valve disposed within said housing;

a redirect outlet passageway in communication with said outlet side of said pumping chamber and said pressure relief valve;

a redirect inlet passageway in communication with said pressure relief valve and said inlet passageway;

said pressure relief valve moveable between a normally closed position, wherein oil is prevented from passing from said redirect outlet passageway to said redirect inlet passageway, and an open position, wherein oil is allowed to pass from said redirect outlet passageway to said redirect inlet passageway;

said relief valve moving from said closed position to said open position when the pressure differential between said redirect outlet passageway and said redirect inlet passageway exceeds a predetermined level;

said relief valve disposed within a bore in said housing, and said relief valve having a spool valve structure that is biased toward said closed position; and a venting passageway extending from said inlet to said bore in said housing for receiving said relief valve in order to maintain atmospheric pressure on both sides of said relief valve.

2. A high-performance oil pump for pumping oil in an internal combustion engine, comprising:

an enclosed housing having a first side and a second side positioned on opposite sides of said housing and a single inlet located on said first side for receiving oil from an oil reservoir and a single outlet located on said second side for discharging oil to said internal combustion engine, wherein said inlet has a longitudinal axis;

a pair of gears rotatably and matingly disposed within a pumping chamber of said housing for pumping oil from said inlet to said outlet, wherein said pumping chamber has a longitudinal axis;

an inlet passageway extending from said inlet to an inlet side of said pumping chamber, wherein said inlet passageway has a longitudinal axis substantially parallel to said longitudinal axis of said pumping chamber and said longitudinal axis of said inlet, wherein said inlet is consistently larger than said inlet passageway from said oil reservoir to said inlet passageway;

an outlet passageway extending from said outlet side of said pumping chamber to said outlet, wherein said outlet is larger than said outlet passageway;

said housing having a bore for receiving a pressure relief valve;

a redirect outlet passageway in communication with said outlet side of said pumping chamber and said pressure relief valve;

a redirect inlet passageway in communication with said pressure relief valve and said inlet passageway;

said pressure relief valve moveable between a normally closed position, wherein all pumped oil is pumped directly to said outlet by preventing oil from passing from said redirect outlet passageway to said redirect inlet passageway, and an open position, wherein a portion of oil is allowed to pass from said redirect outlet passageway to said redirect inlet passageway, in order to increase the pressure on said inlet side of said pair of gears and reduce or eliminate cavitation of said oil pump;

said inlet having an opening communicatable with a supply of oil;

said outlet having an opening communicatable with an engine block;

a strainer removably connected to and extending across said inlet for filtering said oil and minimizing a pressure drop of oil prior to entering said inlet passageway, wherein said strainer is substantially the same diameter as said inlet;

said inlet passageway having a longitudinal axis extending directly from said inlet to said inlet side of said pumping chamber; and a venting passageway extending from said inlet to said bore in said housing for receiving said relief valve to maintain atmospheric pressure on both sides of said relief valve.

* * * * *